US009991081B2

(12) United States Patent
Park et al.

(10) Patent No.: US 9,991,081 B2
(45) Date of Patent: Jun. 5, 2018

(54) ELECTRON EMITTING DEVICE USING GRAPHENE AND METHOD FOR MANUFACTURING SAME

(71) Applicants: SAMSUNG ELECTRONICS CO., LTD., Suwon-si (KR); Kumoh National Institute of Technology Industry-Academic Cooperation Foundation, Gumi-si (KR)

(72) Inventors: Shanghyeun Park, Suwon-si (KR); Donggu Lee, Gumi-si (KR); Ilhwan Kim, Suwon-si (KR); Jaekyung Sung, Gumi-si (KR); Changsoo Lee, Suwon-si (KR); Dongsu Kang, Gumi-si (KR); Euna Yu, Gumi-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days. days.

(21) Appl. No.: 15/310,627

(22) PCT Filed: May 13, 2014

(86) PCT No.: PCT/KR2014/004247
§ 371 (c)(1),
(2) Date: Nov. 11, 2016

(87) PCT Pub. No.: WO2015/174554
PCT Pub. Date: Nov. 19, 2015

(65) Prior Publication Data

US 2017/0084417 A1 Mar. 23, 2017

(51) Int. Cl.
*H01J 19/24* (2006.01)
*H01J 19/44* (2006.01)
(Continued)

(52) U.S. Cl.
CPC ..... *H01J 19/24* (2013.01); *H01J 1/30* (2013.01); *H01J 9/022* (2013.01); *H01J 9/148* (2013.01);
(Continued)

(58) Field of Classification Search
CPC .. H01J 19/24; H01J 19/44; H01J 19/38; H01J 9/148; H01J 9/022; H01J 1/30
See application file for complete search history.

(56) References Cited

U.S. PATENT DOCUMENTS

| | | | |
|---|---|---|---|
| 6,692,327 | B1 | 2/2004 | Deguchi et al. |
| 2013/0169142 | A1 | 7/2013 | Hyde et al. |
| 2014/0191650 | A1 | 7/2014 | Lee et al. |

FOREIGN PATENT DOCUMENTS

| | | | |
|---|---|---|---|
| CN | 102856139 | A | 1/2013 |
| CN | 102339699 | B | 3/2014 |

(Continued)

OTHER PUBLICATIONS

International Search Report—PCT/KR2014/004247 dated Feb. 13, 2015.

(Continued)

*Primary Examiner* — Joseph L Williams
(74) *Attorney, Agent, or Firm* — Cantor Colburn LLP

(57) ABSTRACT

Disclosed are an electron emitting device using graphene and a method for manufacturing the same. The electron emitting device includes a metal holder having at least one slot, at least one emitter plate inserted into the slot to protrude from a first surface of the metal holder, and including an emitter supporting member and a graphene emitter attached onto the emitter supporting member, an insulation layer provided on the first surface of the metal holder, and a gate electrode provided on the insulation layer and including a gate supporting member and a graphene gate attached onto the gate supporting member.

23 Claims, 19 Drawing Sheets

(51) Int. Cl.

| | |
|---|---|
| ***H01J 19/38*** | (2006.01) |
| ***H01J 9/02*** | (2006.01) |
| ***H01J 1/30*** | (2006.01) |
| ***H01J 9/14*** | (2006.01) |

(52) U.S. Cl.
CPC ..... *H01J 19/38* (2013.01); *H01J 19/44* (2013.01); *H01J 2209/022* (2013.01)

(56) References Cited

FOREIGN PATENT DOCUMENTS

| | | | |
|---|---|---|---|
| JP | 3494583 | B2 | 11/2003 |
| JP | 2013179182 | A | 9/2013 |
| KR | 101017036 | B1 | 2/2011 |
| KR | 1091178 | B1 | 12/2011 |
| KR | 1142525 | B1 | 5/2012 |
| KR | 1020130007904 | A | 1/2013 |
| KR | 1020130114470 | A | 10/2013 |
| KR | 101387700 | B1 | 4/2014 |
| WO | 2013009083 | A2 | 1/2013 |
| WO | 2013009083 | A3 | 1/2013 |
| WO | 2013101937 | A1 | 7/2013 |

OTHER PUBLICATIONS

Wei Lei et al., A graphene-based large area surface-conduction electron emission display, Article, 2013, pp. 255-263, 56, Elsevier.
European Extended Search Report for Application No. 14891679.4 dated Jan. 31, 2018, citing the above reference(s).

ELECTRON EMITTING DEVICE USING GRAPHENE AND METHOD FOR MANUFACTURING SAME

TECHNICAL FIELD

The present invention relates to an electron emitting device and, more particularly, to an electron emitting device using graphene and a method for manufacturing the same.

BACKGROUND ART

Conventional electron emitting devices emit hot electrons by heating an element such as a tungsten filament in a vacuum, or emit cold electrons by applying an electric field to carbon nanotubes. Currently, an electron emitting device including a graphene emitter using very thin graphene as an electron emitting source is developed. The electron emitting device including the graphene emitter may be driven at a low voltage to obtain a high current, easily produced in a large array structure, and thus applied to a large display apparatus, a lighting apparatus, a high-resolution electron microscope, etc. In addition, if an anode electrode is made of tungsten, copper, molybdenum, or the like, the electron emitting device may be used as an electron emitting source of an X-ray generator.

DETAILED DESCRIPTION OF THE INVENTION

Technical Problem

At least one embodiment of the present invention provides an electron emitting device using graphene and a method for manufacturing the same.

Advantageous Effects of the Invention

According to an embodiment, since a graphene emitter is provided at an edge of an emitter plate inserted into a metal holder, and provided perpendicularly to a top surface of the metal holder, a field enhancement effect may be maximized. Accordingly, electrons may be efficiently emitted from the graphene emitter. Furthermore, since a graphene gate is provided above the graphene emitter, the electrons emitted from the graphene emitter may reach an anode electrode with directionality without being distributed. An electron emitting device according to the current embodiment may be variously applied to a display apparatus, a lighting apparatus, a high-resolution electron microscope, etc. In addition, if the anode electrode is made of tungsten, copper, molybdenum, or the like, the electron emitting device may be implemented as an electron emitting source of an X-ray generator. Besides, since processes for producing an emitter plate and a gate electrode are simple, an electron emitting device and an electron emitting device array may be easily manufactured.

BEST MODE

Figure 1:
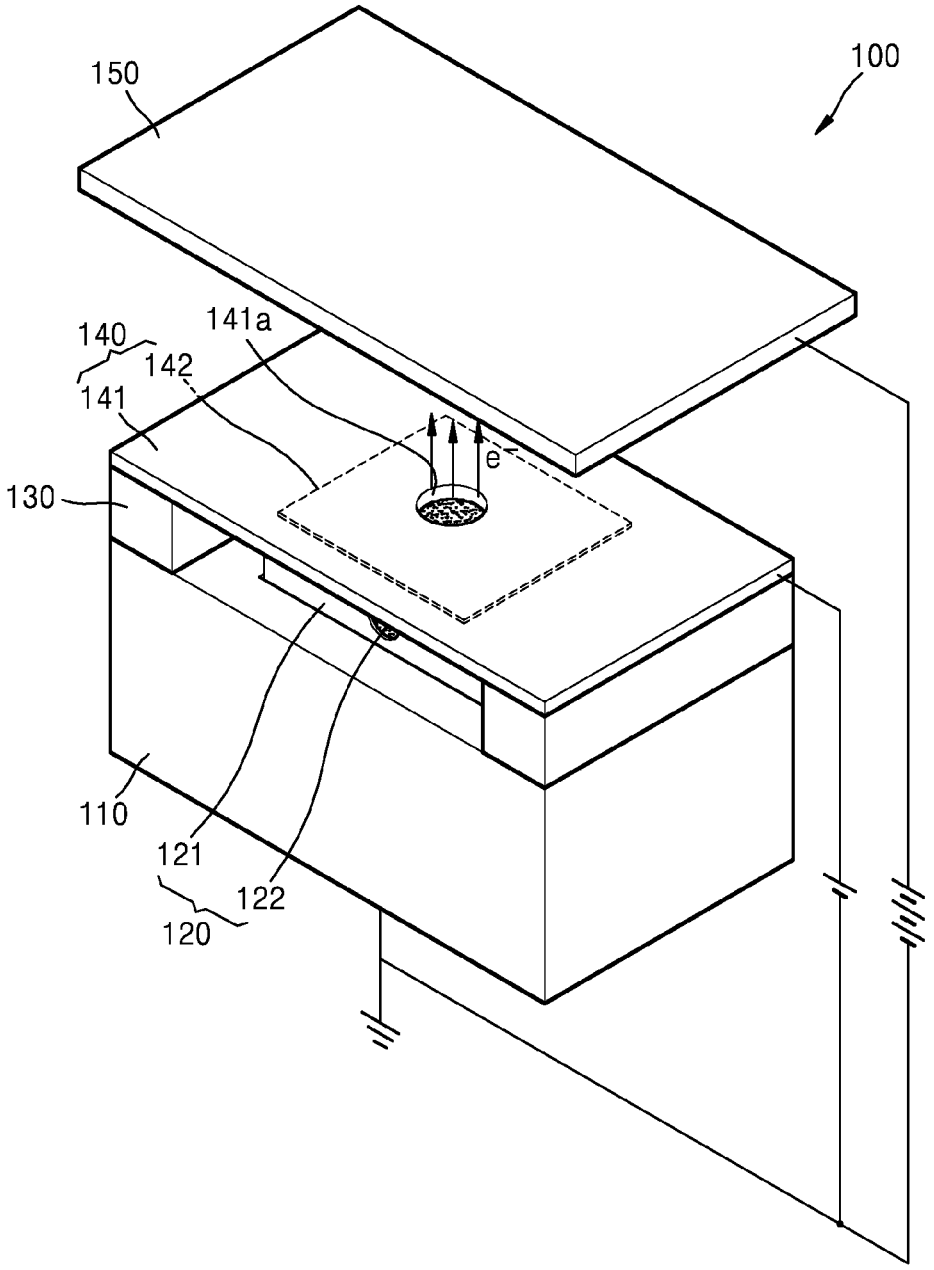
FIG. 1 is a perspective view of an electron emitting device according to an example embodiment.

Hereinafter, the present invention will be described in detail by explaining embodiments of the invention with reference to the attached drawings. The invention may, however, be embodied in many different forms and should not be construed as being limited to the embodiments set forth herein; rather, these embodiments are provided so that this disclosure will be thorough and complete, and will fully convey the concept of the invention to one of ordinary skill in the art. In the drawings, like reference numerals denote like elements, and the sizes or thicknesses of elements are exaggerated for clarity. It will also be understood that when a layer is referred to as being "on" another layer or substrate, it can be directly on the other layer or substrate, or intervening layers may also be present. Materials of layers mentioned below are merely examples and other materials may also be used.

Figure 2:
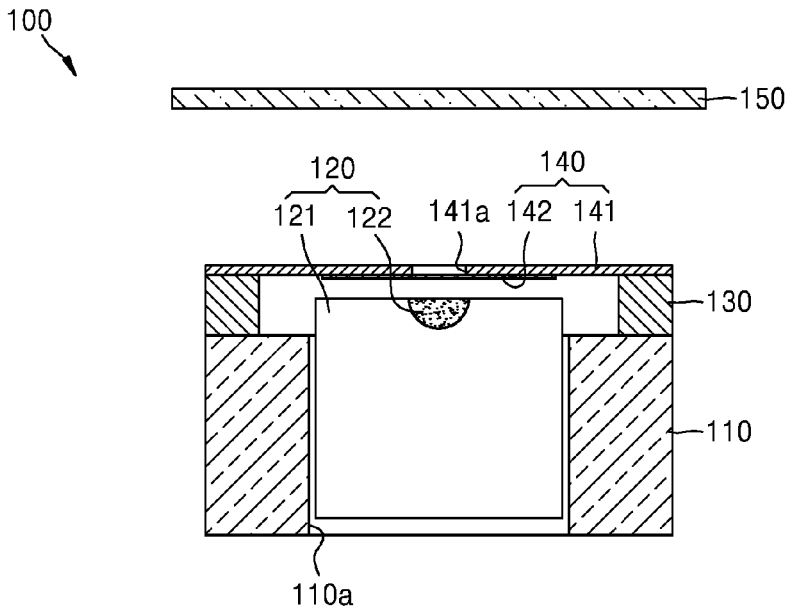
FIG. 2 is a cross-sectional view of the electron emitting device illustrated in FIG. 1.

FIG. 1 is a perspective view of an electron emitting device 100 according to an example embodiment. FIG. 2 is a cross-sectional view of the electron emitting device 100 illustrated in FIG. 1.

Referring to FIGS. 1 and 2, the electron emitting device 100 includes a metal holder 110, an emitter plate 120 inserted into the metal holder 110, an insulation layer 130 provided on the metal holder 110, and a gate electrode 140 provided on the insulation layer 130. Herein, the emitter plate 120 includes an emitter supporting member 121 and a graphene emitter 122 attached onto the emitter supporting member 121. The gate electrode 140 includes a gate supporting member 141 and a graphene gate 142 attached onto the gate supporting member 141.

Figure 3:
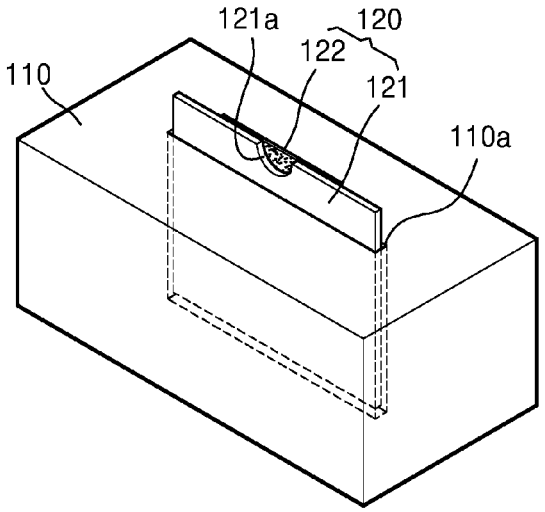
FIG. 3 is a perspective view of a metal holder and an emitter plate of the electron emitting device, according to an example embodiment.

The metal holder 110 may serve as a cathode electrode together with the emitter supporting member 121. The emitter plate 120 is inserted into the metal holder 110. FIG. 3 is a perspective view of the emitter plate 120 inserted into the metal holder 110. Referring to FIG. 3, a slot 110*a* having a predetermined shape penetrates through the metal holder 110. Herein, the slot 110*a* may be provided to penetrate between a first surface (e.g., a top surface) and a second surface (e.g., a bottom surface) of the metal holder 110. The slot 110*a* may align the graphene emitter 122 to be described below, to be perpendicular to the first surface of the metal holder 110. To this end, the slot 110*a* may be provided perpendicularly to the first surface of the metal holder 110. The metal holder 110 may include a metallic material having an excellent electrical conductivity.

Figure 4A:
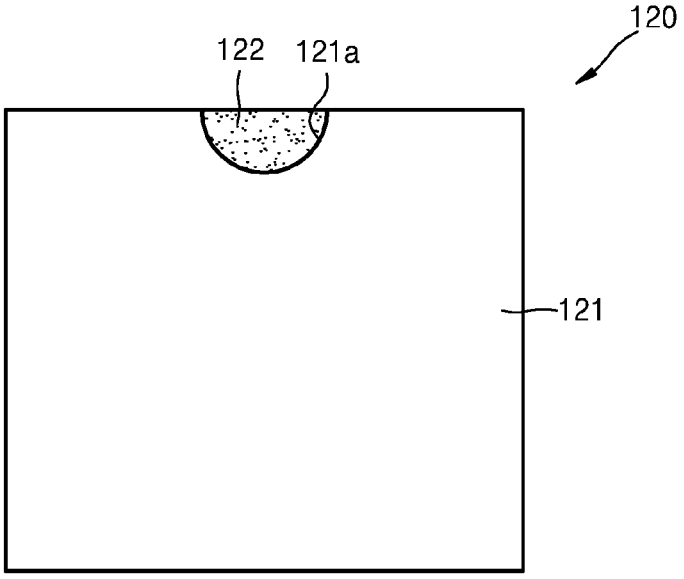
FIGS. 4A and 4B illustrate a front surface and a rear surface of the emitter plate of the electron emitting device, according to an example embodiment, respectively.
Figure 4B:
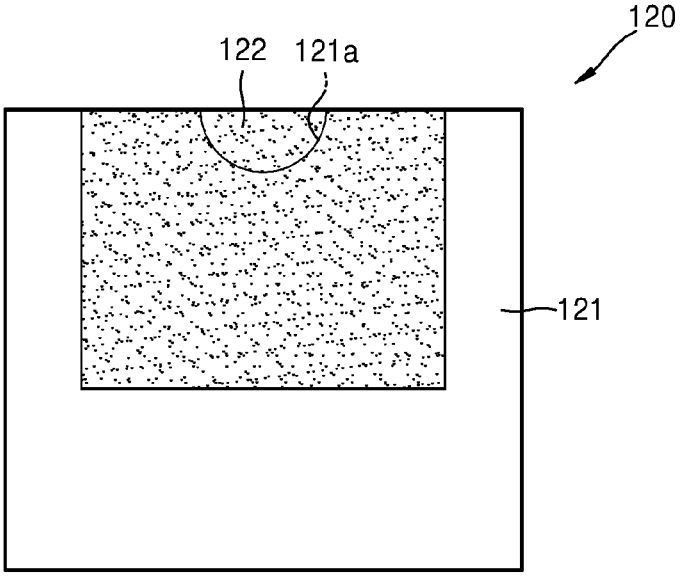

The emitter plate 120 is inserted into the slot 110*a* of the metal holder 110. Herein, the emitter plate 120 is provided to protrude from the first surface of the metal holder 110 by a predetermined height. FIGS. 4A and 4B illustrate a front surface and a rear surface of the emitter plate 120, respectively. Referring to FIGS. 4A and 4B, the emitter plate 120 includes the emitter supporting member 121 and the graphene emitter 122 attached onto the emitter supporting member 121. The emitter supporting member 121 may be a metal film having an emitter groove 121*a* at a top edge thereof. The emitter groove 121*a* may have, for example, a semicircular shape. However, the emitter groove 121*a* is not limited thereto and may have various shapes. The emitter supporting member 121 supports the graphene emitter 122. The emitter supporting member 121 may serve as a cathode electrode together with the above-described metal holder 110. To this end, the emitter supporting member 121 may be electrically connected to the metal holder 110 when inserted into the slot 110*a* of the metal holder 110. Like the metal holder 110, the emitter supporting member 121 may include a metallic material having an excellent electrical conductivity.

The graphene emitter 122 is attached onto the emitter supporting member 121. Specifically, the graphene emitter 122 is attached onto a surface of the emitter supporting member 121 to cover the emitter groove 121*a* provided at the top edge of the emitter supporting member 121. As such, the graphene emitter 122 may be provided at the top edge of the emitter supporting member 121. The graphene emitter 122 may include a graphene sheet having a monolayer or multilayer structure. FIGS. 4A and 4B illustrate an example in which the graphene emitter 122 is attached onto a rear surface of the emitter supporting member 121. However, the graphene emitter 122 may be attached onto a front surface of the emitter supporting member 121. As described above, since the emitter plate 120 is provided to protrude from the first surface of the metal holder 110 by the predetermined height, the graphene emitter 122 provided at the top edge of the emitter supporting member 121 may be exposed above the first surface of the metal holder 110.

Figure 5:
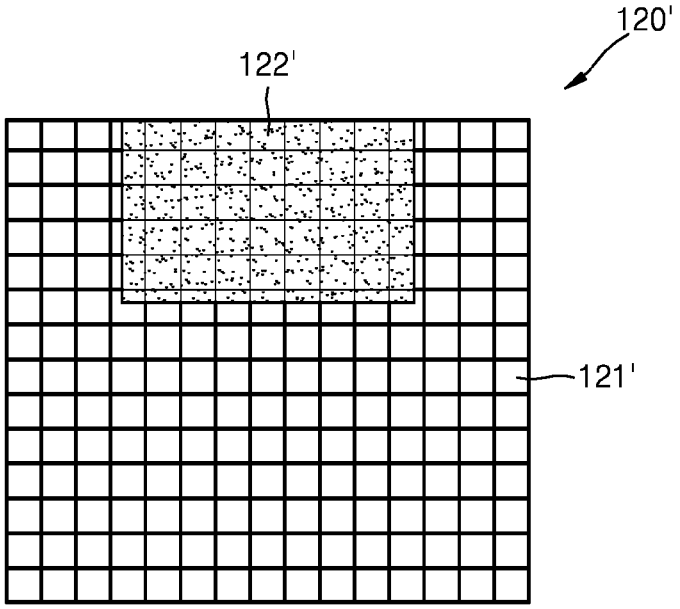
FIG. 5 illustrates a modified emitter plate applied to the electron emitting device, according to an example embodiment.
Figure 6:
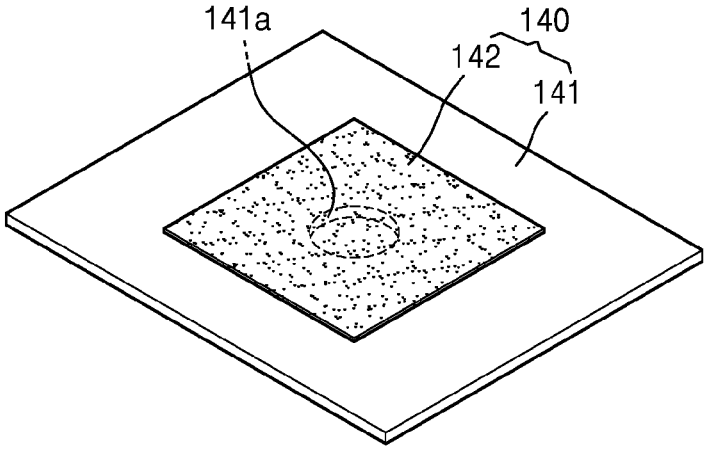
FIG. 6 is a bottom perspective view of a gate electrode of the electron emitting device, according to an example embodiment.

FIG. 5 illustrates a modified emitter plate 120' applicable to the electron emitting device 100 according to the current embodiment. Referring to FIG. 5, the emitter plate 120' includes an emitter supporting member 121' and a graphene emitter 122' attached onto the emitter supporting member 121'. The emitter supporting member 121' may be a grid-type metal mesh. The graphene emitter 122' may be attached onto a surface of the emitter supporting member 121'. In this case, the graphene emitter 122' may be located at a top edge of the emitter supporting member 121'. The graphene emitter 122' may include a graphene sheet having a monolayer or multilayer structure as described above.

Referring back to FIGS. 1 and 2, the insulation layer 130 is provided on the first surface of the metal holder 110. The insulation layer 130 may have a thickness greater than the height of the emitter plate 120 protruding from the first surface of the metal holder 110, in such a manner that the graphene emitter 122 and the gate electrode 140 are spaced apart from each other by a predetermined distance. The gate electrode 140 is provided on the insulation layer 130. FIG. 4 is a bottom perspective view of the gate electrode 140. The gate electrode 140 includes the gate supporting member 141 and the graphene gate 142 attached onto the gate supporting member 141. The gate supporting member 141 may be a metal film having a gate hole 141*a* at a central part thereof. The gate hole 141*a* may be located above the perpendicularly provided graphene emitter 122. The gate hole 141*a* may have, for example, a circular shape. However, the gate hole 141*a* is not limited thereto and may have various shapes. The gate supporting member 141 may include a metallic material having an excellent electrical conductivity. The graphene gate 142 is attached onto the gate supporting member 141. Specifically, the graphene gate 142 is attached onto a surface of the gate supporting member 141 to cover the gate hole 141*a*. The graphene gate 142 may include a graphene sheet having a monolayer or multilayer structure. FIG. 4 illustrates an example in which the graphene gate 142 is attached onto a bottom surface of the gate supporting member 141. However, the graphene emitter 142 may be attached onto a top surface of the gate supporting member 141.

Figure 7:
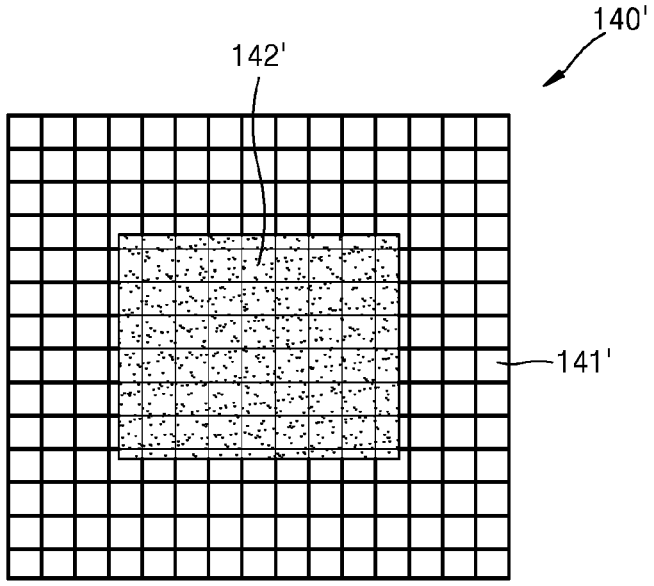
FIG. 7 illustrates a modified gate electrode applied to the electron emitting device, according to an example embodiment.

FIG. 7 illustrates a modified gate electrode 140' applicable to the electron emitting device 100 according to the current embodiment. Referring to FIG. 7, the gate electrode 140' includes a gate supporting member 141' and a graphene gate 142' attached onto the gate supporting member 141'. The gate supporting member 141' may be a grid-type metal mesh. The gate emitter 142' may be attached onto a surface of the gate supporting member 141'. The gate emitter 142' may include a graphene sheet having a monolayer or multilayer structure as described above. Referring back to FIGS. 1 and 2, an anode electrode 150 is provided above the gate electrode 140 to be spaced apart from the gate electrode 140. The anode electrode 150 may include various conductive materials. Although not shown in FIGS. 1 and 2, at least one focusing electrode for focusing electrons emitted from the graphene emitter 122 may be further provided between the gate electrode 140 and the anode electrode 150.

In the above-described electron emitting device 100, when a predetermined voltage is applied to each of the metal holder 110, the gate electrode 140, and the anode electrode 150, electrons are emitted from the graphene emitter 122 due to an electric field created near the graphene emitter 122. The emitted electrons pass through the graphene gate 142 and reach a desired location on the anode electrode 150. Herein, since the graphene emitter 122 is provided at a top edge of the emitter plate 120 perpendicularly to the first surface (e.g., the top surface) of the metal holder 110, a field enhancement effect may be maximized. Accordingly, the electrons may be efficiently emitted from the graphene emitter 122. In addition, since the graphene gate 142 is provided directly above the graphene emitter 122, the electrons emitted from the graphene emitter 122 may reach the anode electrode 150 with directionality without being distributed. The electron emitting device 100 according to the current embodiment may be variously applied to a display apparatus, a lighting apparatus, a high-resolution electron microscope, etc. In addition, if the anode electrode 150 is made of tungsten, copper, molybdenum, or the like, the electron emitting device 100 may be implemented as an electron emitting source of an X-ray generator.

Figure 8:
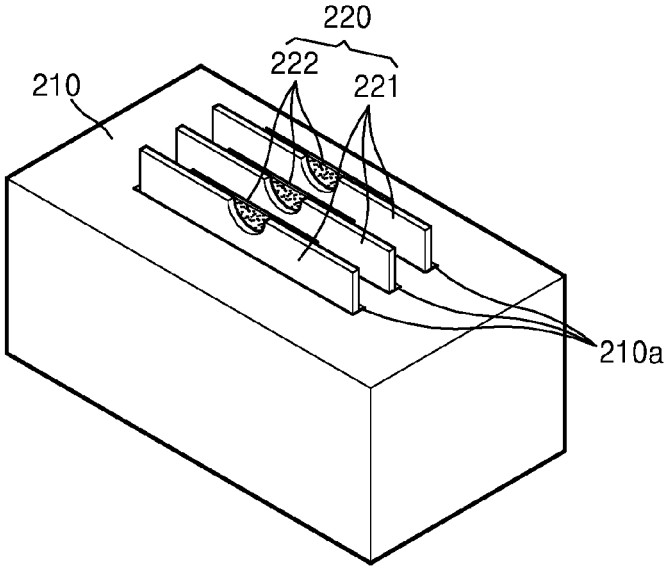
FIG. 8 is a perspective view of a metal holder and emitter plates according to another example embodiment.

FIG. 8 is a perspective view of a metal holder 210 and a plurality of emitter plates 220 according to another example embodiment. Referring to FIG. 8, the metal holder 210 includes a plurality of slots 210*a*, and the emitter plates 220 are inserted into the slots 210*a*. Herein, the emitter plates 220 are provided to protrude from a first surface (e.g., a top surface) of the metal holder 210 by a predetermined height. Each of the emitter plates 220 includes an emitter supporting member 221 and a graphene emitter 222 attached onto the emitter supporting member 221. The emitter supporting member 221 may be a metal film having an emitter hole at a top edge thereof. In this case, the graphene emitter 222 is provided on a surface of the emitter supporting member 221 to cover the emitter hole. As such, the graphene emitter 222 is provided at the top edge of the emitter supporting member 221. The emitter supporting member 221 may be a metal mesh as illustrated in FIG. 5. Although FIG. 8 illustrates an example in which three emitter plates 220 are inserted into the metal holder 210, various numbers of emitter plates may be inserted into the metal holder 210 as necessary.

FIGS. 9 to 14 are views for describing a method for manufacturing an electron emitting device according to another example embodiment.

Figure 9:
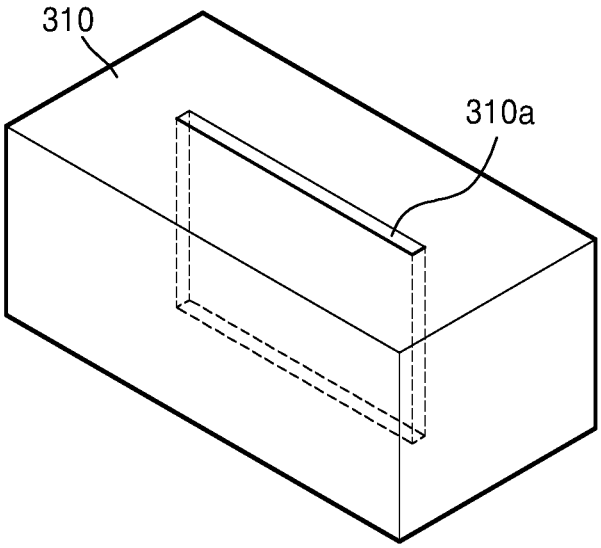
FIGS. 9 to 14 are views for describing a method for manufacturing an electron emitting device according to another example embodiment.

Referring to FIG. 9, a metal holder 310 having a slot 310*a* is prepared. Herein, the slot 310*a* may be provided to penetrate through the metal holder 310 from a first surface (e.g., a bottom surface in FIG. 9) to a second surface (e.g., a top surface in FIG. 9) of the metal holder 310. The slot 310*a* may be provided perpendicularly to the first surface (or the second surface) of the metal holder 310. The metal holder 310 may include a metallic material having an excellent electrical conductivity.

Figure 10:
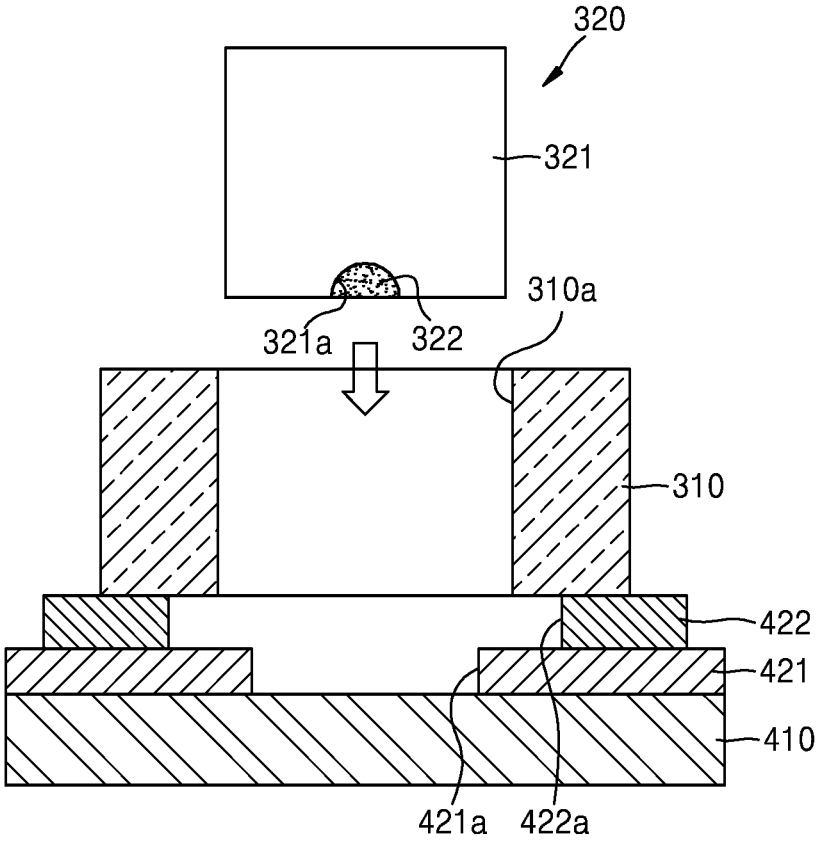

Referring to FIG. 10, first and second supporters 421 and 422 are sequentially provided on a base 410, and then the metal holder 310 is provided on the second supporter 422. Herein, the first surface of the metal holder 310 is provided to contact the second supporter 422. The first supporter 421 may include a first through hole 421*a* having a width smaller than the width of the slot 310*a*, and the second supporter 422 may include a second through hole 422*a* having a width larger than the width of the slot 310*a*. The second supporter 422 may have a thickness corresponding to a height of an emitter plate 320 protruding from the metal holder 310 as will be described below. The metal holder 310 may be provided on the second supporter 422 in such a manner that the slot 310*a* is located on the first and second through holes 421*a* and 422*a*.

Subsequently, the emitter plate 320 is prepared. The emitter plate 320 includes an emitter supporting member 321 and a graphene emitter 322 attached onto the emitter supporting member 321. The emitter supporting member 321 may be a metal film having an emitter groove 321*a* at an edge (e.g., a bottom edge in FIG. 10) thereof. The emitter groove 321*a* may have, for example, a semicircular shape. However, the emitter groove 321*a* is not limited thereto and may have various shapes. The emitter supporting member 321 supports the graphene emitter 322. The graphene emitter 322 may be attached onto a surface of the emitter supporting member 321 to cover the emitter groove 321*a*. As such, the graphene emitter 322 is located at an edge of the emitter plate 320. The graphene emitter 322 may include a graphene sheet having a monolayer or multilayer structure. The emitter supporting member 321 may be a metal mesh as illustrated in FIG. 5. In this case, the graphene emitter 322 may be provided on a surface of the emitter supporting member 321 to cover the edge of the emitter supporting member 321. Then, the prepared emitter plate 320 is inserted into the slot 310*a* of the metal holder 310. Herein, the edge (e.g., the bottom edge at which the graphene emitter 322 is provided in FIG. 10) of the emitter plate 320 is initially inserted into the slot 310*a* from the second surface (e.g., the top surface in FIG. 10) of the metal holder 310.

Figure 11:
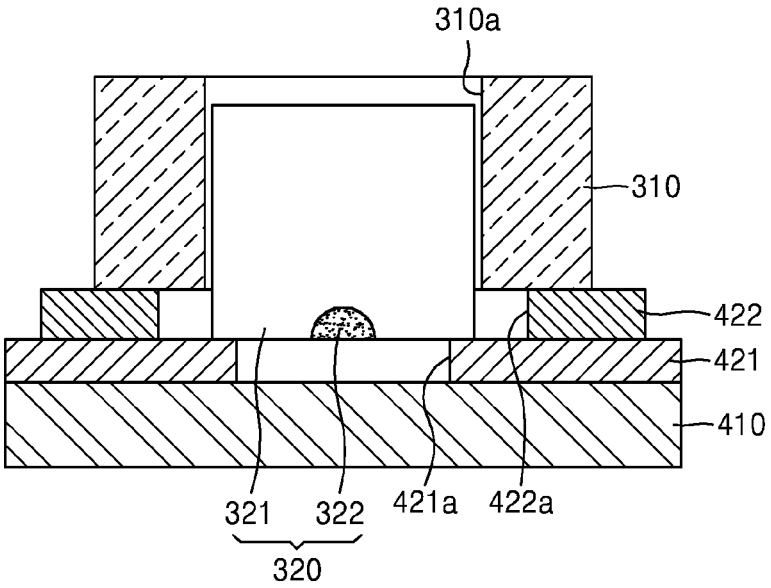
Figure 12:
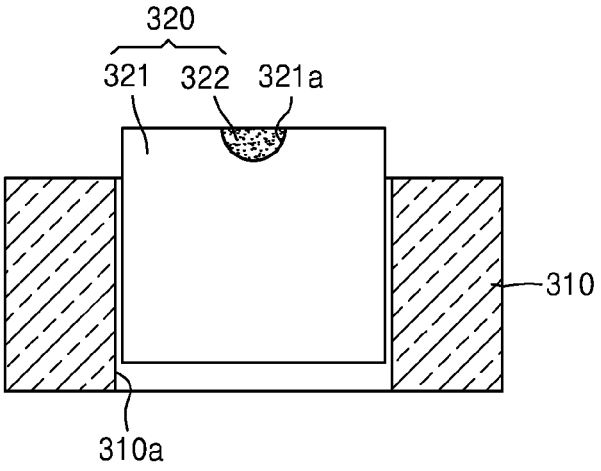

Referring to FIG. 11, the emitter plate 320 is inserted into the slot 310*a* in such a manner that the edge (e.g., the bottom edge at which the graphene emitter 322 is provided in FIG. 11) of the emitter plate 320 protrudes from the first surface (e.g., the bottom surface in FIG. 11) of the metal holder 310. Herein, the emitter plate 320 protrudes from the first surface (e.g., the bottom surface in FIG. 11) of the metal holder 310 to penetrate through the second through hole 422*a* and contact a top surface of the first supporter 421. Therefore, the height of the emitter plate 320 protruding from the first surface of the metal holder 310 corresponds to the thickness of the second supporter 422. As described above, since the height of the emitter plate 320 exposed from the first surface of the metal holder 310 varies depending on the thickness of the second supporter 422, the distance between the graphene emitter 322 and a gate electrode 420 may be controlled by adjusting the thickness of the second supporter 422. Subsequently, the emitter plate 320 is fixed in the slot 310*a* by using a conductive adhesive. As such, the metal holder 310 and the emitter supporting member 321 may be electrically connected to each other, and thus may serve as a cathode electrode together. The metal holder 310 produced as described above and the emitter plate 320 inserted into the metal holder 310 are illustrated in FIG. 12. FIG. 12 illustrates a state in which the metal holder 310 and the emitter plate 320 produced in FIG. 11 are turned over. Referring to FIG. 12, the edge (e.g., the top edge at which the graphene emitter 322 is provided in FIG. 12) of the emitter plate 320 protrudes from the first surface (e.g., the top surface in FIG. 12) of the metal holder 310 by the predetermined height.

Figure 13:
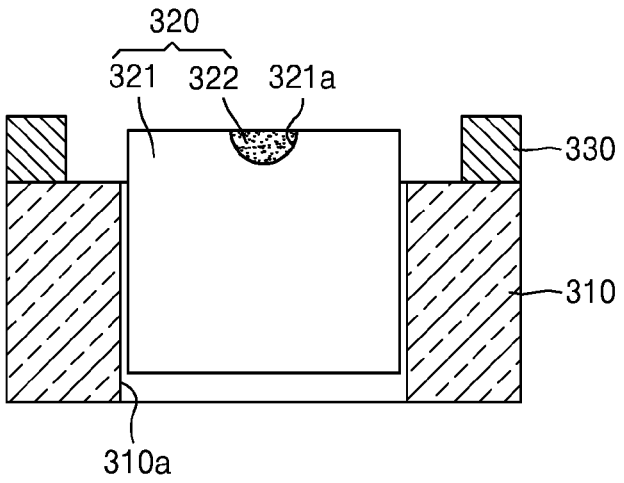

Referring to FIG. 13, an insulation layer 330 is formed on the first surface (e.g., the top surface in FIG. 13) of the metal holder 310. Herein, the insulation layer 330 may have a thickness greater than the height of the emitter plate 320 protruding from the first surface of the metal holder 310.

Figure 14:
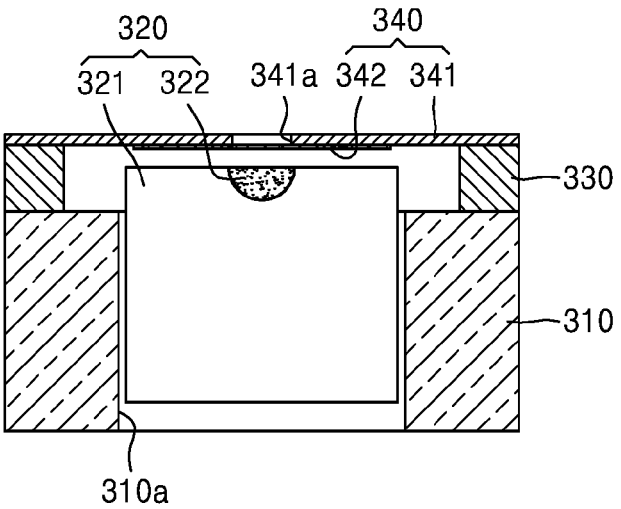

Referring to FIG. 14, a gate electrode 340 is prepared. The gate electrode 340 includes a gate supporting member 341 and a graphene gate 342 attached onto the gate supporting member 341. The gate supporting member 341 may be a metal film having a gate hole 341*a* at a central part thereof. The gate hole 341*a* may be located above the perpendicularly provided graphene emitter 322. The gate hole 341*a* may have, for example, a circular shape. However, the gate hole 341*a* is not limited thereto and may have various shapes. The gate supporting member 341 may include a metallic material having an excellent electrical conductivity. The graphene gate 342 is attached onto the gate supporting member 341. Specifically, the graphene gate 342 is attached onto a surface of the gate supporting member 341 to cover the gate hole 341*a*. The graphene gate 342 may include a graphene sheet having a monolayer or multilayer structure. The gate supporting member 341 may be a metal mesh as illustrated in FIG. 7. In this case, the graphene gate 342 may be attached onto a surface of the gate supporting member 341. Then, the prepared gate electrode 340 is attached onto a top surface of the insulation layer 330. Thereafter, an anode electrode (not shown) is provided on the gate electrode 340 and thus the electron emitting device is completely manufactured.

FIGS. 15 to 20 are views for describing a method for producing an emitter plate 520 according to another example embodiment.

Figure 15:
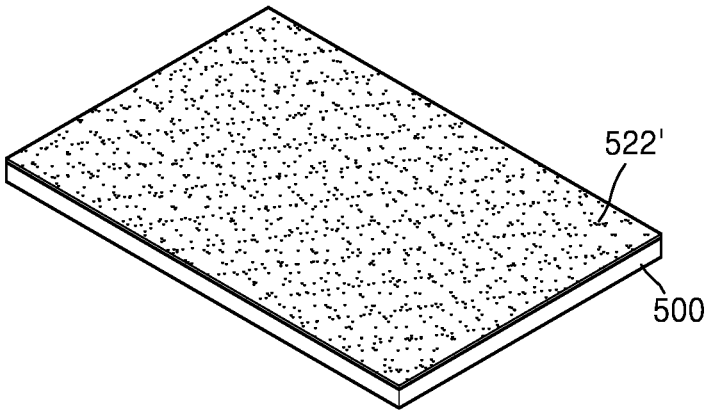
FIGS. 15 to 20 are views for describing a method for producing an emitter plate according to another example embodiment.
Figure 16:
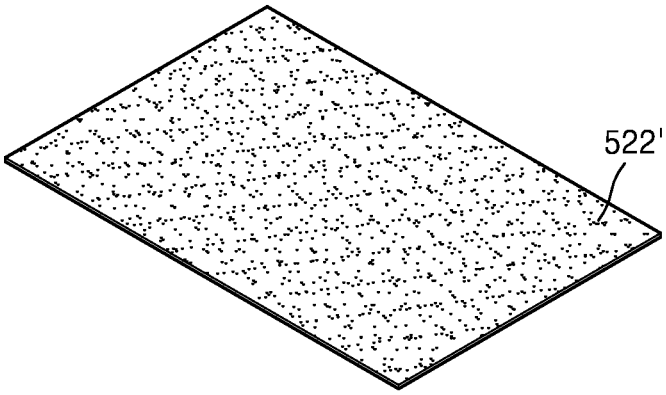

Referring to FIG. 15, initially, a growth substrate 500 is prepared. The growth substrate 500 is used to grow graphene thereon. The growth substrate 500 may include, for example, metal such as copper, nickel, iron, or cobalt, but is not limited thereto. Subsequently, a graphene layer 522' is formed on the growth substrate 500. Herein, the graphene layer 522' may be formed by growing graphene on the growth substrate 500 based on chemical vapor deposition (CVD). If the growth substrate 500 includes, for example, copper, the graphene layer 522' may have a monolayer structure. If the growth substrate 500 includes for example, transition metal such as nickel, iron, or cobalt, the graphene layer 522' may have a multilayer structure. The temperature and time for growing graphene may be, for example, about 800 to 1000° C. and about 30 minutes to 2 hours, respectively, but are not limited thereto. A gas used to grow graphene may include hydrogen and hydrocarbon. Subsequently, referring to FIG. 16, the growth substrate 500 is removed using a predetermined etchant and thus only the graphene layer 522' is left in the etchant.

Figure 17:
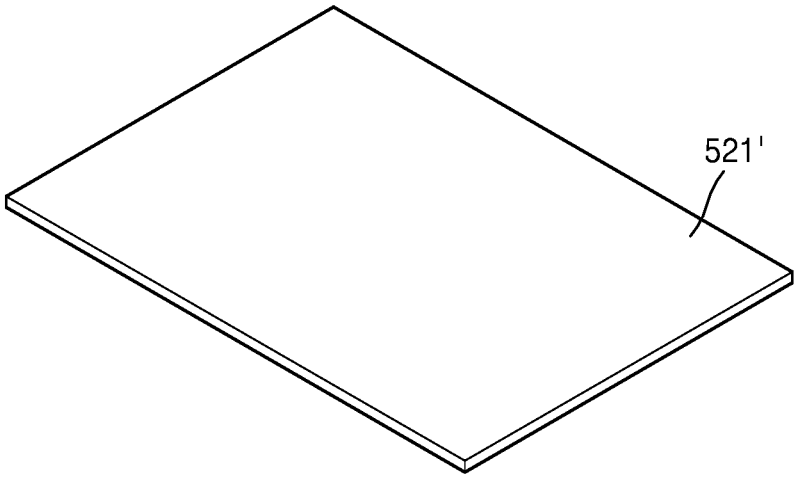
Figure 18:
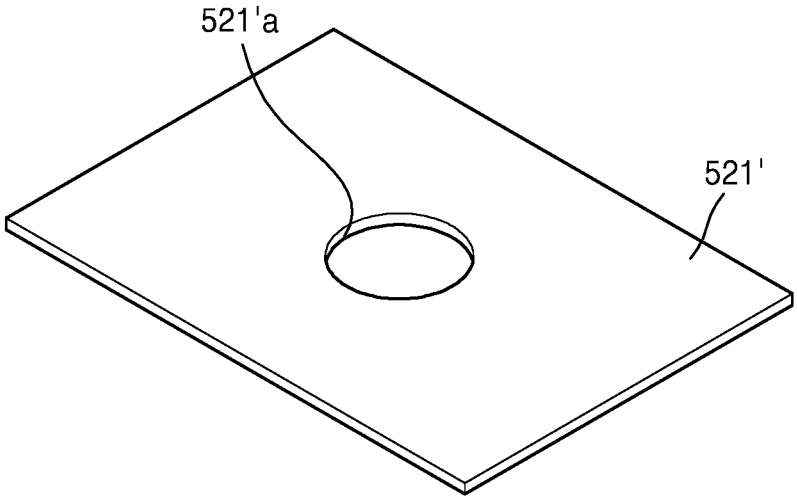

Referring to FIG. 17, a metal film 521' is prepared. Herein, the metal film 521' may have a thickness capable of maintaining the shape thereof by itself. Referring to FIG. 18, through hole 521'*a* is formed in the metal film 521'. The through hole 521'*a* may be formed based on, for example, punching or photo etching. The through hole 521'*a* may be formed at a central part of the metal film 521'. The through hole 521'*a* may have, for example, a circular shape. However, the through hole 521'*a* is not limited thereto and may have various shapes.

Figure 19:
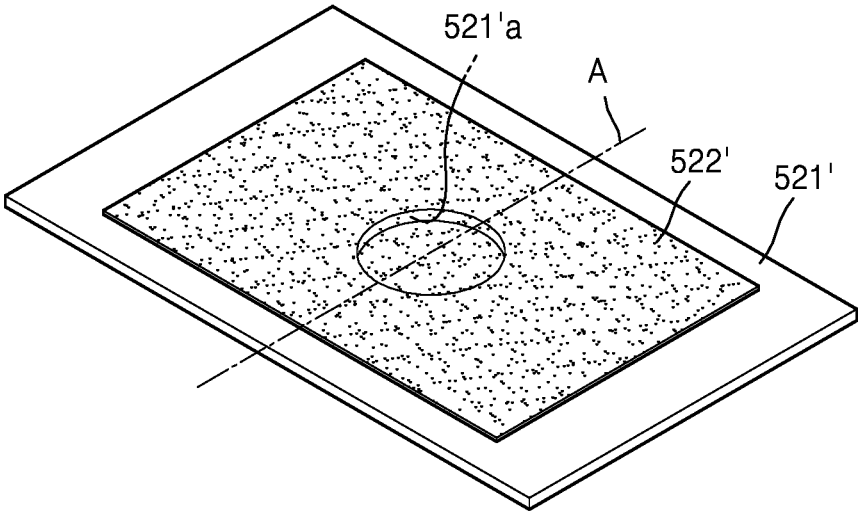
Figure 20:
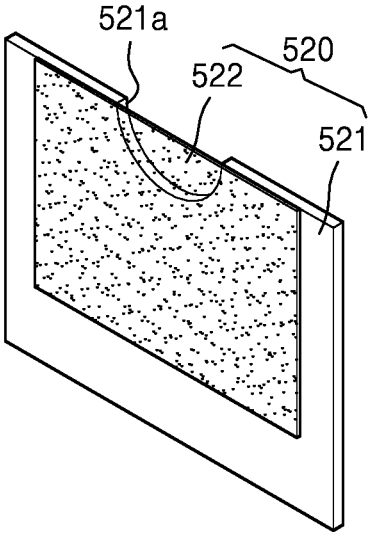

Referring to FIG. 19, the graphene layer 522' is transferred onto the metal film 521'. Herein, the graphene layer 522' may be attached onto a surface of the metal film 521' to cover the through hole 521'*a*. Subsequently, the metal film 521' and the graphene layer 522' are cut along a cutting line A passing through the through hole 521'*a*. As such, the emitter plate 520 including an emitter supporting member 521 having an emitter groove 521*a* at an edge thereof, and a graphene emitter 522 attached onto a surface of the emitter supporting member 521 to cover the emitter groove 521 a may be completely produced as illustrated in FIG. 20. As described above, the emitter plate 520 may be easily produced. Although the graphene layer 522' is transferred onto the metal film 521' having the through hole 521'*a* in the above description, the emitter plate 520 may be produced by attaching the graphene layer 522' onto a surface of a metal mesh (not shown) and then cutting the metal mesh and the graphene layer 522'.

FIGS. 21 to 24 are views for describing a method for producing a gate electrode 640 according to another example embodiment.

Figure 21:
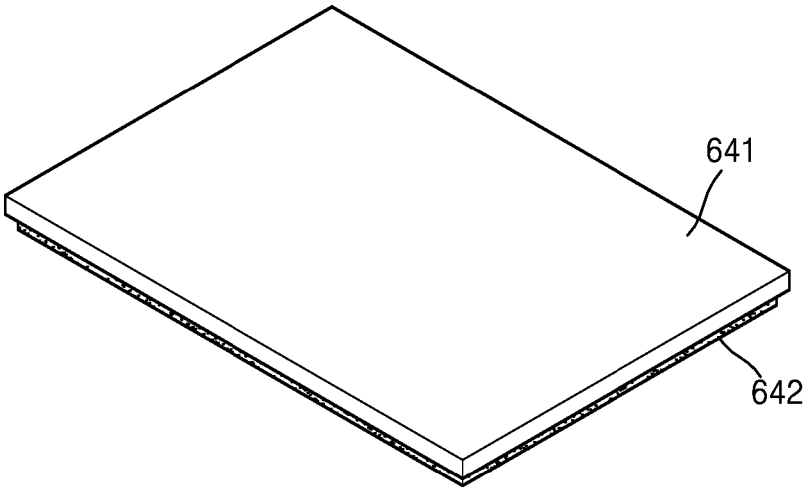
FIGS. 21 to 24 are views for describing a method for producing a gate electrode according to another example embodiment.

Referring to FIG. 21, a metal film 641 is prepared and then a graphene layer 642 is formed on a surface (e.g., a bottom surface in FIG. 21) of the metal film 641. Herein, the metal film 641 is used to grow graphene thereon. The graphene layer 642 may be formed by growing graphene on the metal film 641 based on CVD. The temperature and time for growing graphene may be, for example, about 800 to 1000° C. and about 30 minutes to 2 hours, respectively, but are not limited thereto. A gas used to grow graphene may include hydrogen and hydrocarbon.

Figure 22:
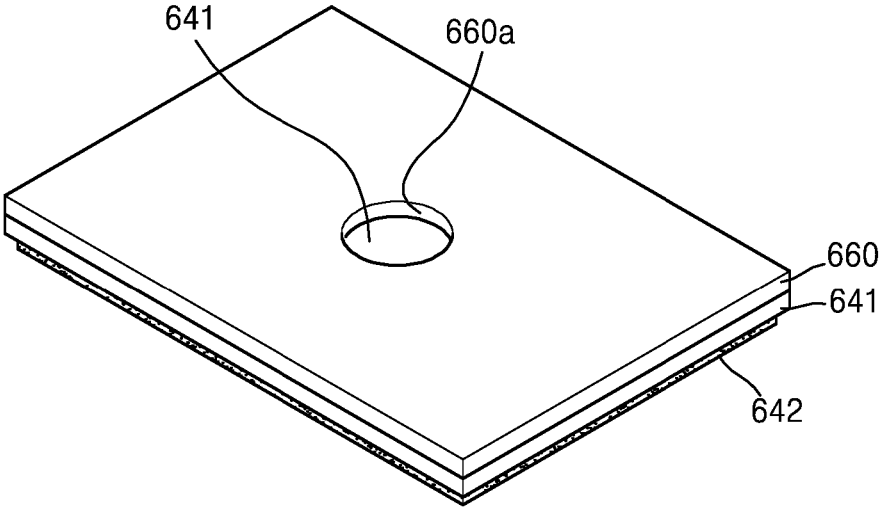
Figure 23:
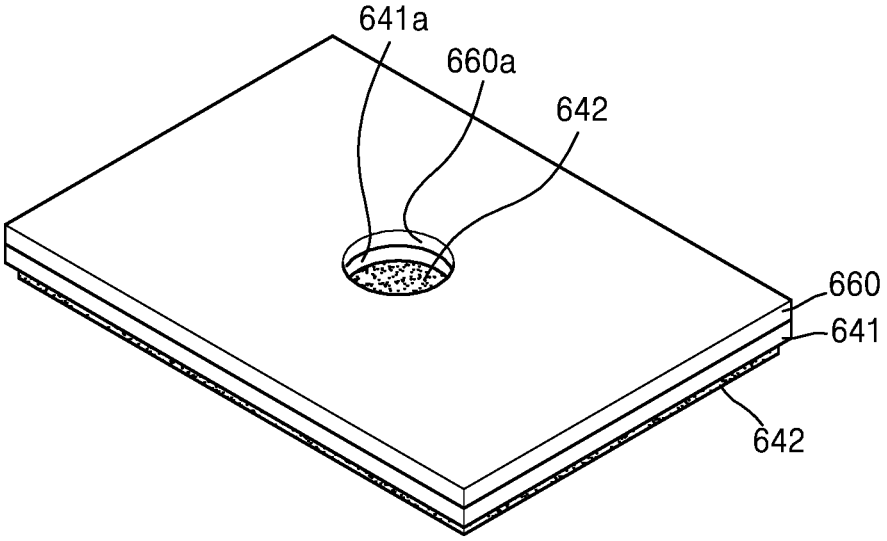
Figure 24:
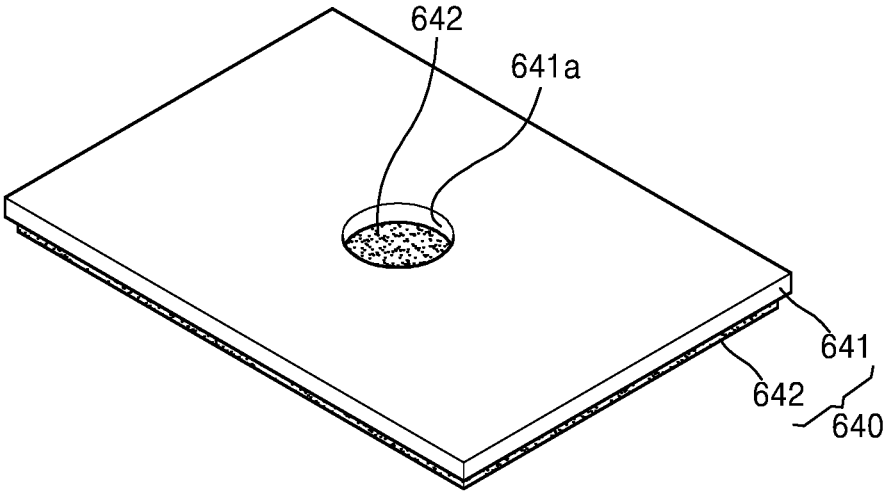

Referring to FIG. 22, a polymer layer 660 is formed on another surface (e.g., a top surface in FIG. 22) of the metal film 641. The polymer layer 660 may include, for example, an oxidation-resistant polymer layer. Subsequently, a through hole 660*a* is formed by patterning the polymer layer 660 to expose the other surface (e.g., the top surface) of the metal film 641. Then, referring to FIG. 23, the metal film 641 exposed by the through hole 660*a* is selectively etched and removed. As such, a gate hole 641*a* may be formed in the metal film 641 to expose the graphene layer 642. Subsequently, referring to FIG. 24, the polymer layer 660 is removed using a predetermined etchant and thus the gate electrode 640 including the metal film 641 having the gate hole 641*a*, and the graphene layer 642 attached onto the metal film 641 is completely produced. Herein, the metal film 641 and the graphene layer 642 correspond to the gate supporting member 141 and the graphene gate 142 of the electron emitting device 100 illustrated in FIG. 1, respectively. As described above, the gate electrode 640 may be easily produced.

FIGS. 25 to 29 are views for describing a method for producing a gate electrode 640 according to another example embodiment.

Figure 25:
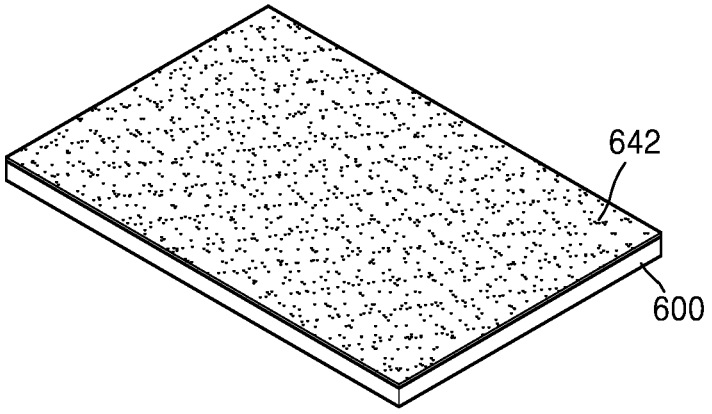
FIGS. 25 to 29 are views for describing a method for producing a gate electrode according to another example embodiment.
Figure 26:
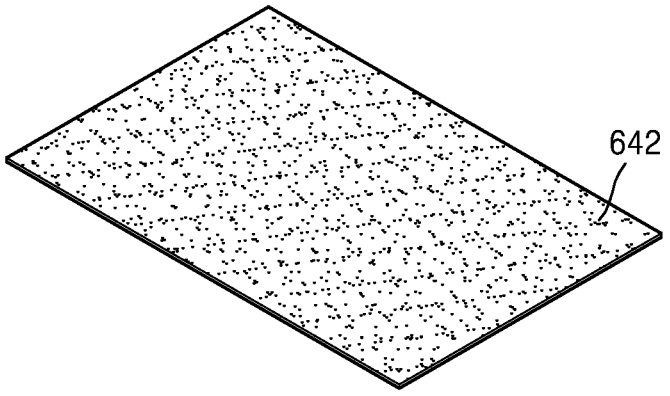

Referring to FIG. 25, a growth substrate 600 is prepared. The growth substrate 600 may include, for example, copper, nickel, iron, or cobalt, but is not limited thereto. Subsequently, a graphene layer 642 is formed on the growth substrate 600. Herein, the graphene layer 642 may be formed by growing graphene on the growth substrate 600 based on CVD. The temperature and time for growing graphene may be, for example, about 800 to 1000° C. and about 30 minutes to 2 hours, respectively, but are not limited thereto. A gas used to grow graphene may include hydrogen and hydrocarbon. Subsequently, referring to FIG. 26, the growth substrate 600 is removed using a predetermined etchant and thus only the graphene layer 642 is left in the etchant.

Figure 27:
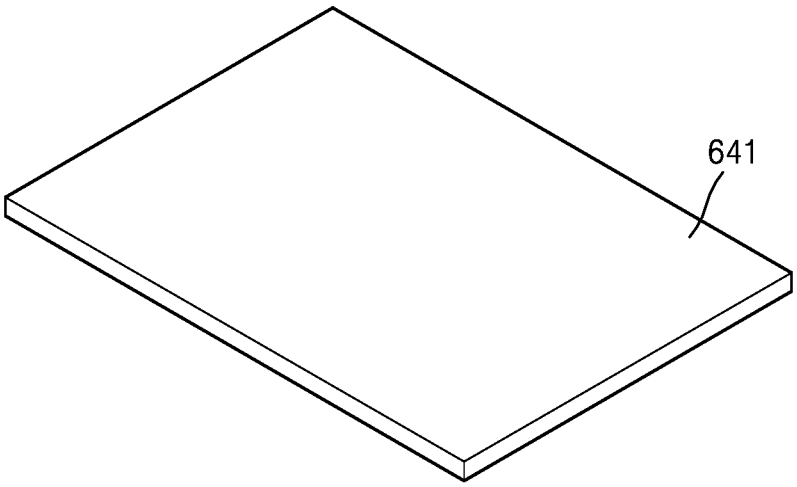
Figure 28:
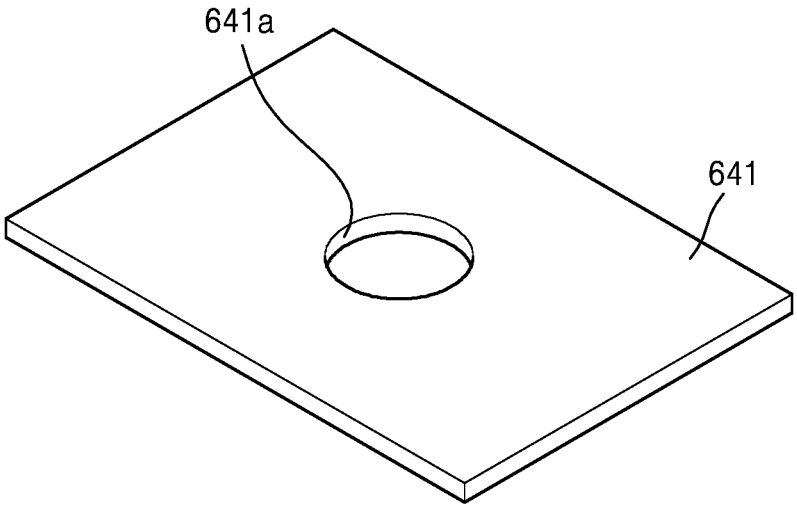

Referring to FIG. 27, a metal film 641 is prepared. Herein, the metal film 641 may have a thickness capable of maintaining the shape thereof by itself. Referring to FIG. 28, a gate hole 641*a* is formed in the metal film 641. The gate hole 641*a* may be formed based on, for example, punching or photo etching. The gate hole 641*a* may have, for example, a circular shape. However, the gate hole 641*a* is not limited thereto and may have various shapes.

Figure 29:
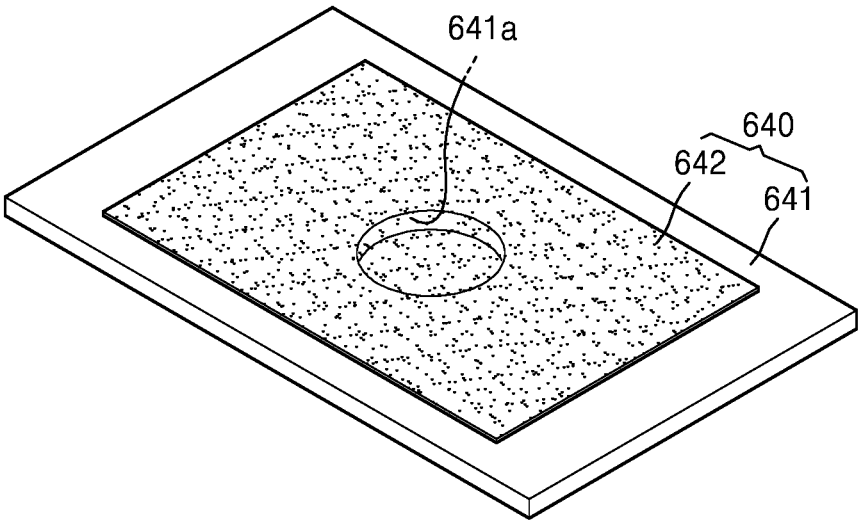

Referring to FIG. 29, the graphene layer 642 is transferred onto the metal film 641. Herein, the graphene layer 642 may be attached onto a surface of the metal film 641 to cover the gate hole 641*a*. As such, the gate electrode 640 including the metal film 641 having the gate hole 641*a*, and the graphene layer 642 attached onto the metal film 641 is completely produced. Herein, the metal film 641 and the graphene layer 642 correspond to the gate supporting member 141 and the graphene gate 142 of the electron emitting device 100 illustrated in FIG. 1, respectively. Although the graphene layer 642 is transferred onto the metal film 641 having the gate hole 641*a* in the above description, the gate electrode 640 may be produced by attaching the graphene layer 642 onto a surface of a metal mesh.

Figure 30A:
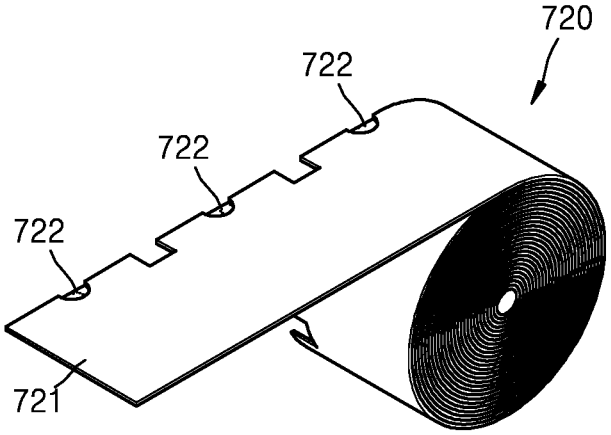
FIG. 30A illustrates a roll-type emitter plate.
Figure 30B:
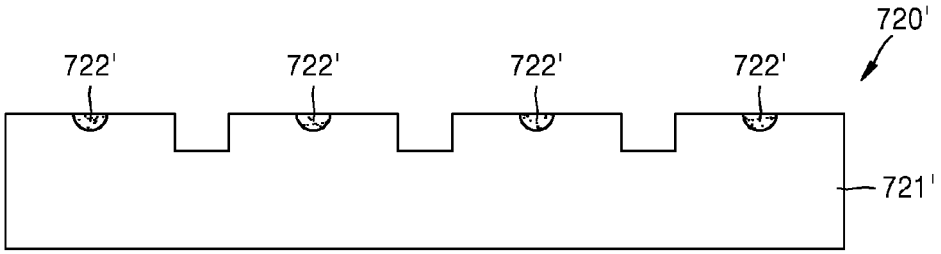
FIG. 30B illustrates an emitter plate produced by cutting a part of the roll-type emitter plate illustrated in FIG. 30A.

FIG. 30A illustrates a roll-type emitter plate 720. Referring to FIG. 30A, the emitter plate 720 includes an emitter supporting member 721 and a plurality of graphene emitters 722 attached onto a surface of the emitter supporting member 721. Herein, the graphene emitters 722 may be provided at an edge of the emitter supporting member 721 at equal intervals. The emitter plate 720 may be produced through the processes described above in relation to FIGS. 15 to 20, and then wound in the form of a roll. The roll-type emitter plate 720 produced as described above may be easily stored and kept. As necessary, the roll-type emitter plate 720 may be cut to a desired length and used. FIG. 30B illustrates an emitter plate 720' produced by cutting a part of the roll-type emitter plate 720 illustrated in FIG. 30A. The emitter plate 720' includes an emitter supporting member 721' and a plurality of graphene emitters 722' attached onto a surface of the emitter supporting member 721'. The emitter plate 720' illustrated in FIG. 30B may be used to produce, for example, a large-area electron emitting device array.

Figure 31:
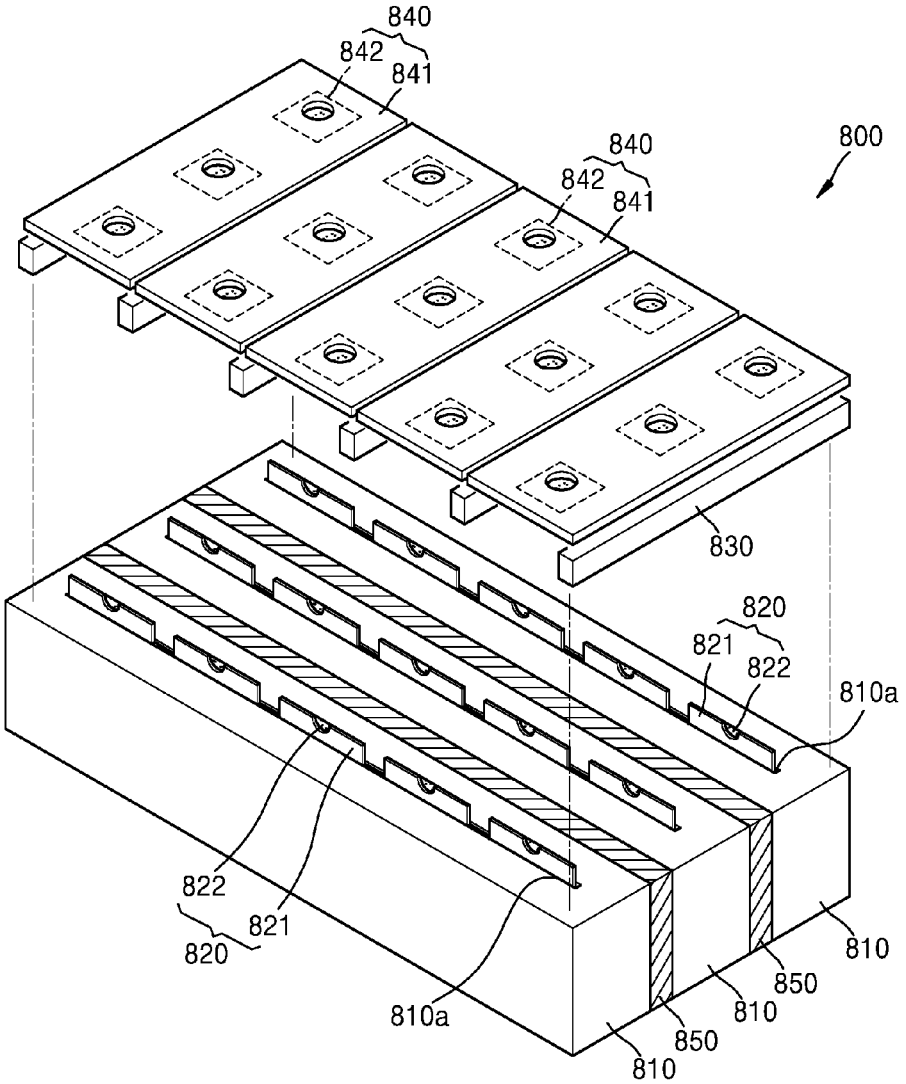
FIG. 31 is an exploded perspective view of an electron emitting device array according to another example embodiment.

FIG. 31 is an exploded perspective view of an electron emitting device array 800 according to another example embodiment.

Referring to FIG. 31, the electron emitting device array 800 according to the current embodiment includes a plurality of electron emitting devices arranged in two dimensions. Herein, the structure of each of the electron emitting devices is the same as that of the electron emitting device 100 illustrated in FIG. 1. The electron emitting devices may be independently driven to emit electrons.

Specifically, the electron emitting device array 800 includes a plurality of metal holders 810, a plurality of emitter plates 820 inserted into the metal holders 810, an insulation layer 830 provided on the metal holders 810, and a plurality of gate electrodes 840 provided on the insulation layer 830. Herein, the electron emitting devices are provided at locations where the metal holders 810 and the gate electrodes 840 cross each other. The metal holders 810 are provided in parallel to each other at equal intervals, and insulation members 850 are provided between the metal holders 810. The metal holders 810 include slots 810*a* provided along length directions of the metal holders 810. The emitter plates 820 are inserted into the slots 810*a*, and upper parts of the emitter plates 820 protrude from top surfaces of the metal holders 810.

Each of the emitter plates 820 includes an emitter supporting member 821 and a plurality of graphene emitters 822 attached onto a surface of the emitter supporting member 821. Herein, the graphene emitters 822 are provided at equal intervals at a top edge of the emitter plate 820. The graphene emitters 822 may be provided perpendicularly to the top surface of the metal holder 810, and protrude from the top surface of the metal holder 810. Detailed descriptions of the emitter supporting member 821 and the graphene emitters 822 are given above and thus omitted herein. For example, the emitter plate 720' illustrated in FIG. 30B may be used as the emitter plate 820.

The insulation layer 830 is provided on the metal holders 810. The gate electrodes 840 are provided on the insulation layer 830. Herein, the gate electrodes 840 may be provided in parallel to each other to cross the metal holders 810. For example, the gate electrodes 840 may be provided to perpendicularly cross the metal holders 810. Each of the gate electrodes 840 includes a gate supporting member 841 and a plurality of graphene gates 842 attached onto a surface of the gate supporting member 841. Herein, the graphene gates 842 may be provided directly above the graphene emitters 822. The graphene gates 842 attached onto the gate supporting member 841 may be integrated with each other. Detailed descriptions of the gate supporting member 841 and the graphene gates 842 are given above and thus omitted herein. Although not shown in FIG. 31, anode electrodes may be provided above the gate electrodes 840 to be spaced apart from the gate electrodes 840 by a certain distance.

In the above-described electron emitting device array 800, when voltages are applied to at least one of the metal holders 810 and at least one of the gate electrodes 840, electrons may be emitted from the electron emitting device provided at a location where the metal holder 810 and the gate electrode 840 cross each other. As described above, the electron emitting devices included in the electron emitting device array 800 may be independently driven to emit electrons.

While the present invention has been particularly shown and described with reference to embodiments thereof, it will be understood by one of ordinary skill in the art that various changes in form and details may be made therein without departing from the spirit and scope of the present invention as defined by the following claims.

Mode of the Invention

According to an aspect of the present invention, an electron emitting device includes:

a metal holder having at least one slot;

at least one emitter plate inserted into the slot to protrude from a first surface of the metal holder, and including an emitter supporting member and a graphene emitter attached onto the emitter supporting member;

an insulation layer provided on the first surface of the metal holder; and a gate electrode provided on the insulation layer and including a gate supporting member and a graphene gate attached onto the gate supporting member.

The graphene emitter may be provided perpendicularly to the first surface of the metal holder. The graphene emitter may be provided at an edge of the emitter supporting member.

The emitter supporting member may include a metal film having an emitter groove at an edge thereof, and the graphene emitter may be attached onto the metal film to cover the emitter groove. Alternatively, the emitter supporting member may include a metal mesh, and the graphene emitter may be attached onto the metal mesh.

The gate supporting member may include a metal film having a gate hole, and the graphene gate may be attached onto the metal film to cover the gate hole. Alternatively, the gate supporting member may include a metal mesh, and the graphene gate may be attached onto the metal mesh.

An anode electrode may be provided above the gate electrode to be spaced apart from the gate electrode. The emitter supporting member may be inserted into the slot and electrically connected to the metal holder. Each of the graphene emitter and the graphene gate may include a graphene sheet having a monolayer or multilayer structure.

According to another aspect of the present invention, a method for manufacturing an electron emitting device includes:

preparing a metal holder having a slot;

preparing an emitter plate including an emitter supporting member and a graphene emitter attached onto the emitter supporting member;

locating the metal holder on a supporter and then inserting the emitter plate into the slot of the metal holder;

allowing the emitter plate to protrude from a first surface of the metal holder by a predetermined height;

forming an insulation layer on the first surface of the metal holder;

preparing a gate electrode including a gate supporting member and a graphene gate attached onto the gate supporting member; and providing the gate electrode on the insulation layer.

The supporter may include a first supporter including a first through hole having a width smaller than the width of the slot, and a second supporter stacked on the first supporter and including a second through hole having a width larger than the width of the slot. The metal holder may be provided on the second supporter, and the second supporter may have a thickness corresponding to the height of the emitter plate protruding from the first surface of the metal holder.

The preparing of the emitter plate may include preparing a growth substrate and then forming a graphene layer on the growth substrate, removing the growth substrate, preparing a metal film and then forming a through hole in the metal film, transferring the graphene layer onto the metal film to cover the through hole, and cutting the metal film along a cutting line passing through the through hole. The growth substrate may include copper, nickel, iron, or cobalt. The graphene layer may be formed by growing graphene on the growth substrate based on chemical vapor deposition (CVD).

The preparing of the emitter plate may include preparing a growth substrate and then forming a graphene layer on the growth substrate, removing the growth substrate, preparing a metal mesh and then transferring the graphene layer onto the metal mesh, and cutting the metal mesh.

The preparing of the gate electrode may include forming a graphene layer on a first surface of a metal film, forming a polymer layer on a second surface of the metal film and then patterning the polymer layer, forming a gate hole in the metal film by etching the second surface of the metal film exposed by the patterned polymer layer, and removing the patterned polymer layer.

The preparing of the gate electrode may include preparing a growth substrate and then forming a graphene layer on the growth substrate, removing the growth substrate, preparing a metal film and then forming a gate hole in the metal film, and transferring the graphene layer onto the metal film to cover the gate hole.

The preparing of the gate electrode may include preparing a growth substrate and then forming a graphene layer on the growth substrate, removing the growth substrate, and preparing a metal mesh and then transferring the graphene layer onto the metal mesh.

According to another aspect of the present invention, an electron emitting device array includes a plurality of electron emitting devices arranged in two dimensions, each of the electron emitting devices including:

a metal holder having at least one slot;

at least one emitter plate inserted into the slot to protrude from a first surface of the metal holder, and including an emitter supporting member and a graphene emitter attached onto the emitter supporting member;

an insulation layer provided on the first surface of the metal holder; and a gate electrode provided on the insulation layer and including a gate supporting member and a graphene gate attached onto the gate supporting member.

The invention claimed is:

1. An electron emitting device comprising:

a metal holder having at least one slot;

at least one emitter plate inserted into the slot to protrude from a first surface of the metal holder, and comprising an emitter supporting member and a graphene emitter attached onto the emitter supporting member;

an insulation layer provided on the first surface of the metal holder; and a gate electrode provided on the insulation layer and comprising a gate supporting member and a graphene gate attached onto the gate supporting member.

2. The electron emitting device of claim 1, wherein the graphene emitter is provided perpendicularly to the first surface of the metal holder.

3. The electron emitting device of claim 2, wherein the graphene emitter is provided at an edge of the emitter supporting member.

4. The electron emitting device of claim 3, wherein the emitter supporting member comprises a metal film having an emitter groove at an edge thereof, and wherein the graphene emitter is attached onto the metal film to cover the emitter groove.

5. The electron emitting device of claim 3, wherein the emitter supporting member comprises a metal mesh, and wherein the graphene emitter is attached onto the metal mesh.

6. The electron emitting device of claim 1, wherein the gate supporting member comprises a metal film having a gate hole, and wherein the graphene gate is attached onto the metal film to cover the gate hole.

7. The electron emitting device of claim 1, wherein the gate supporting member comprises a metal mesh, and wherein the graphene gate is attached onto the metal mesh.

8. The electron emitting device of claim 1, wherein an anode electrode is provided above the gate electrode to be spaced apart from the gate electrode.

9. The electron emitting device of claim 1, wherein the emitter supporting member is inserted into the slot and electrically connected to the metal holder.

10. The electron emitting device of claim 1, wherein each of the graphene emitter and the graphene gate comprises a graphene sheet having a monolayer or multilayer structure.

11. A method for manufacturing an electron emitting device, the method comprising:

preparing a metal holder having a slot;

preparing an emitter plate comprising an emitter supporting member and a graphene emitter attached onto the emitter supporting member;

locating the metal holder on a supporter and then inserting the emitter plate into the slot of the metal holder;

allowing the emitter plate to protrude from a first surface of the metal holder by a predetermined height;

forming an insulation layer on the first surface of the metal holder;

preparing a gate electrode comprising a gate supporting member and a graphene gate attached onto the gate supporting member; and providing the gate electrode on the insulation layer.

12. The method of claim 11, wherein the supporter comprises:

a first supporter comprising a first through hole having a width smaller than the width of the slot; and a second supporter stacked on the first supporter and comprising a second through hole having a width larger than the width of the slot.

13. The method of claim 12, wherein the metal holder is provided on the second supporter, and wherein the second supporter has a thickness corresponding to the height of the emitter plate protruding from the first surface of the metal holder.

14. The method of claim 11, wherein the graphene emitter is provided perpendicularly to the first surface of the metal holder.

15. The method of claim 11, wherein the preparing of the emitter plate comprises:

preparing a growth substrate and then forming a graphene layer on the growth substrate;

removing the growth substrate;

preparing a metal film and then forming a through hole in the metal film;

transferring the graphene layer onto the metal film to cover the through hole; and cutting the metal film along a cutting line passing through the through hole.

16. The method of claim 15, wherein the growth substrate comprises copper, nickel, iron, or cobalt.

17. The method of claim 15, wherein the graphene layer is formed by growing graphene on the growth substrate based on chemical vapor deposition (CVD).

18. The method of claim 11, wherein the preparing of the emitter plate comprises:

preparing a growth substrate and then forming a graphene layer on the growth substrate;

removing the growth substrate;

preparing a metal mesh and then transferring the graphene layer onto the metal mesh; and cutting the metal mesh.

19. The method of claim 11, wherein the preparing of the gate electrode comprises:

forming a graphene layer on a first surface of a metal film;

forming a polymer layer on a second surface of the metal film and then patterning the polymer layer;

forming a gate hole in the metal film by etching the second surface of the metal film exposed by the patterned polymer layer; and removing the patterned polymer layer.

20. The method of claim 11, wherein the preparing of the gate electrode comprises:

preparing a growth substrate and then forming a graphene layer on the growth substrate;

removing the growth substrate;

preparing a metal film and then forming a gate hole in the metal film; and transferring the graphene layer onto the metal film to cover the gate hole.

21. The method of claim 11, wherein the preparing of the gate electrode comprises:

preparing a growth substrate and then forming a graphene layer on the growth substrate;

removing the growth substrate; and preparing a metal mesh and then transferring the graphene layer onto the metal mesh.

22. An electron emitting device array comprising a plurality of electron emitting devices arranged in two dimensions, each of the electron emitting devices comprising:

a metal holder having at least one slot;

at least one emitter plate inserted into the slot to protrude from a first surface of the metal holder, and comprising an emitter supporting member and a graphene emitter attached onto the emitter supporting member;

an insulation layer provided on the first surface of the metal holder; and a gate electrode provided on the insulation layer and comprising a gate supporting member and a graphene gate attached onto the gate supporting member.

23. The electron emitting device array of claim 22, wherein the graphene emitter is provided perpendicularly to the first surface of the metal holder and provided at an edge of the emitter supporting member.

* * * * *